United States Patent [19]

Durand

[11] Patent Number: 4,923,284

[45] Date of Patent: May 8, 1990

[54] ANTI-DAZZLE SCREEN

[75] Inventor: Robert E. Durand, Rambouillet, France

[73] Assignee: Materials Et Applications De Securite Pour Les Aeroports L'Industrie Et Les Routes (Masair), Paris, France

[21] Appl. No.: 254,963

[22] Filed: Oct. 7, 1988

[30] Foreign Application Priority Data

Oct. 7, 1987 [FR] France ..... 87 13842

[51] Int. Cl.[5] ..... G02B 27/00

[52] U.S. Cl. ..... 350/276 R; 350/266; 350/321

[58] Field of Search ..... 350/276 R, 266, 321

[56] References Cited

FOREIGN PATENT DOCUMENTS 0285419 5/1928 United Kingdom ..... 350/276 R

*Primary Examiner*—Bruce Y. Arnold
*Assistant Examiner*—Rebecca D. Gass
*Attorney, Agent, or Firm*—Wolf, Greenfield & Sacks

[57] ABSTRACT

An anti-dazzle screen is formed from a strip provided with notches (4, 5) issuing in alternation from opposing upper and lower edges. The notches form branches (8) therebetween and terminate short of the opposing edge to form upper and lower connection parts (9, 10) along the upper and lower edges, respectively. The connection lower parts (10) are at least partly foldable to form a supporting and fixing tab (12) for the screen on a support. The strip (1) is opened out on being positoned in the direction of setting up to open out the branches (8) around the respective joints formed by the upper and lower parts (9, 10).

7 Claims, 2 Drawing Sheets

ANTI-DAZZLE SCREEN

BACKGROUND OF THE INVENTION

The present invention relates to an anti-dazzle screen particularly intended for the separation of road traffic lanes to prevent the lights of vehicles running in one direction from dazzling or tiring the drivers of vehicles coming in the opposition direction.

Various types of anti-dazzle screens are in existence. Generally, these screens are fixed on the central separation barrier and are made up of upright panels, slanted for separating the traffic lanes in opaque manner for drivers looking ahead of them, while constituting a transparent barrier when the observer looks in a transversal direction.

These known anti dazzle screens have a certain number of drawbacks associated with their discontinuous structure, with the need to fix the elements separately on the central barrier, or to make up comb-shaped arrangements on which the panels are fixed, and the arrangements themselves are positioned between the two lanes.

The complexity of the construction of these arrangements is reflected in a corresponding high cost.

The present invention has for its object to obviate the drawbacks of the known arrangements, and it is intended to provide an anti-dazzle screen simple and inexpensive to make, of small overall size before erection and which, once erected, supplies an efficient anti-dazzle screen.

SUMMARY OF THE INVENTION

For this purpose, the invention relates to an anti-dazzle screen characterized in that it is made from a strip, the strip being provided with notches starting from the "upper" edge and notches starting from the "lower" edge, said notches not extending right over the width of the strip;

the notches starting from the upper edge and those starting from the lower edge following one another alternately to form branches in the space between two succeeding notches, "upper" connection parts between two succeeding notches emanating from the "upper" edge and above the intermediate notch emanating from the "lower" edge and in each instance joining the corresponding ends of two successive branches;

lower connection parts between two succeeding notches emanating from the bottom edge and below the intermediate notch emanating from the upper edge, the lower parts being at least partly foldable to constitute on each occasion a tab for resting and fixing the screen onto a support;

the strip provided with the notches opening out on fitting in the positioning direction to open the branches around the respective joint formed on each occasion by the upper part and the lower part connecting two succeeding branches to move these branches apart and incline them the ones relative to the others and arrange their surface slantwise relative to the mounting line to constitute an opaque screen in the direction along the screen.

Said screen is made from a screen by notches in alternation starting from its two edges. This manufacture is particularly simple. Such a strip may also be simply stored as a roll the rolled length of which will depend upon the weight of the material constituting the strip, so that the rolls may be easily handled. These rolls are also easily carried to the place of installation of the anti-dazzle screen. There, it will be sufficient to unwind the roll, loaded for example on a lorry, to fix it, continuously, for example on the central separation barrier of traffic lanes. Putting in place is very simple. It will be sufficient to nail, or similarly fix, the tabs folded down at the base of the lower part of the join between every other branch. The slant of the tabs is automatically adjusted depending on the pitch which has been chosen for the screen.

The partial replacement of such an anti-dazzle screen is done with the same ease for any part destroyed or damaged, for example, in an accident.

According to another characteristic of the invention the upper part is constituted by a bead.

This bead which constitutes wholly or partly the upper part forms a joint and a reinforced upper end connecting the two branches and imparting to them a certain hold, while allowing opening out the two branches.

According to another characteristic the notches end in a rounded opening.

With this rounded opening ending each notch it is prevented that the notch might progress beyond the opening and weaken the bottom or top part constituting the joint by creating a weak area of preferential rupture.

According to another characteristic of the invention the strip is obtained by extrusion. This manufacturing process is particularly practical whatever the profile of the strip might be, in particular if, as stated above, the upper part is made up of a bead and if, as pointed out, according to another characteristic of the invention, the bottom part constituting the support is made folded when the strip is extruded. The angle of fold may be 90° or, preferably, equal to the angle of slant of the branches (i.e., matching the pitch) once the screen has been opened out and fixed.

BRIEF DESCRIPTION OF THE DRAWINGS

The present invention will be described in more detailed manner with the aid of the attached drawings wherein.

DETAILED DESCRIPTION OF THE PREFERRED EMBODIMENTS

Figure 1:
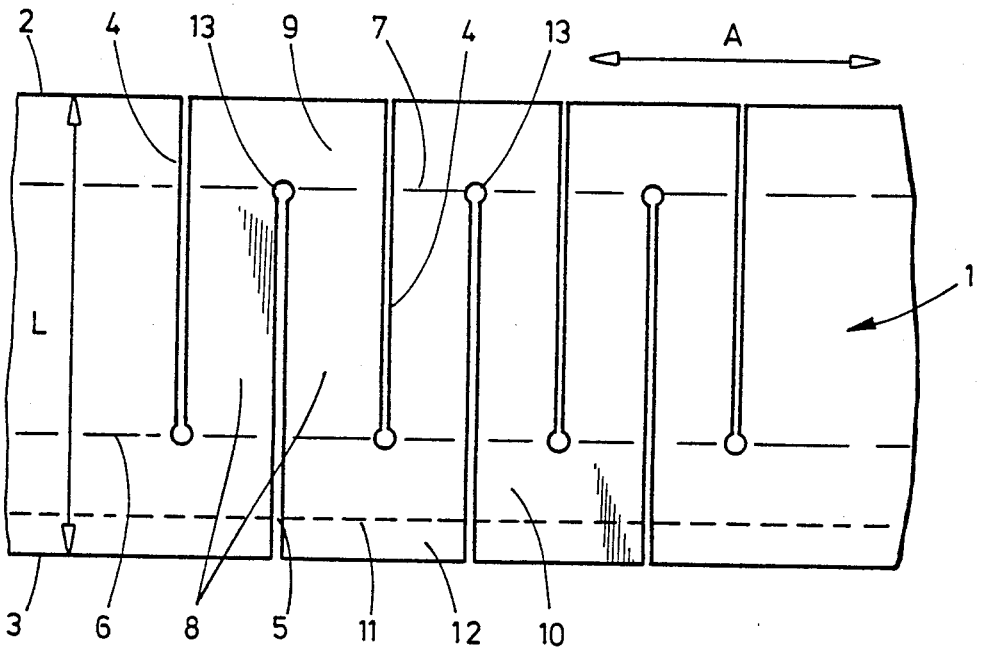
FIG. 1 is a plan view of an example of embodiment of an anti-dazzle screen strip of the invention.

According to FIG. 1 the anti-dazzle screen of the invention consists of a strip denoted overall by reference 1. This strip has an upper edge 2 and a lower edge 3. The terms "upper" and "lower" have been chosen in relation to the use and setting up of the strip. It is a mere convention.

The strip has vertical notches 4 starting from the upper edge 2 and vertical notches 5 starting from the bottom edge 3. The notches 4 and 5 do not extend right across the width L but stop at certain distance from the opposite edge. Thus, the notches 4 starting from the upper edge 2 stop at a horizontal line 6 and the notches 5 starting from the lower edge 3 stop at a horizontal line 7. The notches 4 and 5 follow one another in alternation and thus form the various constituent parts of the anti-dazzle screen, and thus succeeding notches 4 and 5 create in their space branches 8 comprised between the two lines 6 and 7;

between two consecutive notches 4, 4, emanating from the upper edge 2, there is a connecting "upper" part 9 above the end of the intermediate notch 5 emanating from the lower edge 3. This upper part 9 connects in each case the upper end of two consecutive branches 8;

between two notches 5 emanating from the lower edge and below the lower end of the intermediate notch 4 issuing from the upper edge 2 there is a lower part 10 between the lower edge 3 and the line 6. This lower part 10, may, if need be, subdivided by a folding line 11 so as to form near the edge 3 a tab 12 which can be folded down partly, and acting as a support and fixing tab for the putting in place of the strip after opening out, as an anti-dazzle screen.

Figure 3:
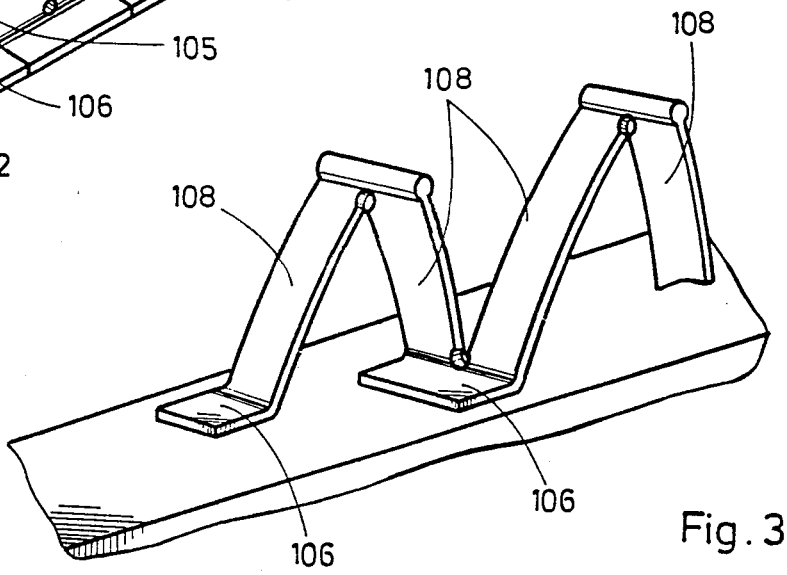
FIG. 3 is a perspective view of the strip of FIG. 2 after installation on a barrier.

The strip thus made may be rolled-up and delivered at the place of installation of the rolls which are then unwound. To open out the strip which has thus a Greek key or crenellated pattern, the strip is pulled in the direction of arrow A so as to swivel the branches 8 out of the plane of the strip and spread them out by opening the branches around the joint at each end formed by the upper part and the lower part. Thus an arrangement is obtained as shown in FIG. 3.

Figure 2:
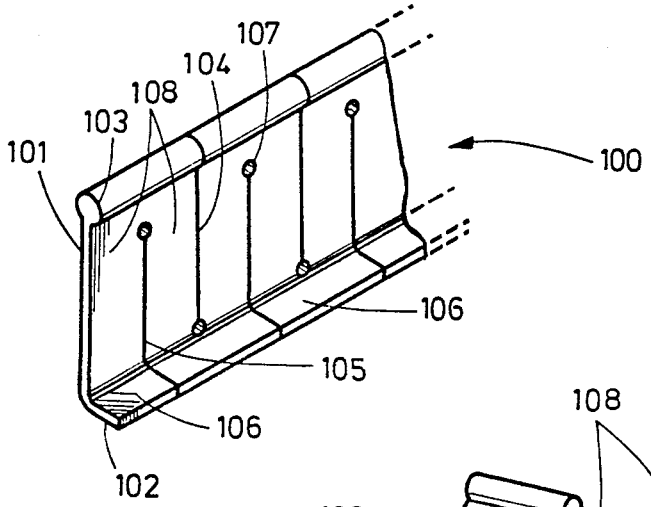
FIG. 2 is a perspective view of another example of embodiment of an anti-dazzle screen strip according to the invention.

FIG. 2 shows a particular form of strip before opening out. This strip 100 has an L-shaped section with a main part 101 and a part 102 substantially perpendicular to the main part. At the top it has a bead 103. Notches 104, 105, issuing respectively from the upper edge (i.e., that having the bead 103) and from the lower edge (i.e., that having the tab 102) alternate in succession to form the branches 108 and the tabs 106.

As indicated hereinabove, the lower part 102 constituting the tabs 106 may form with part 101 an angle different from 90° and preferably an angle corresponding to the arrangement of the tabs 106 after opening out. This angle is dependent on the pitch selected.

The strip may be obtained by extrusion of a synthetic material, such as plastic, selected on the basis of the conditions of use, etc. If need be, this strip may also be made of metal.

Finally, it should be pointed out that the notches each end in rounded holes 13, 107, which prevents the notch from extending beyond the intended length, and from being continued by a tear weakening the connection between two succeeding branches.

The arrangement of the strip depends upon the direction of traffic (to the right or the left); this is effected simply by the manner of opening out the strip in one direction or the other.

It should be observed that the setting in place of the strip on a concrete central slide is effected without any special difficulties.

Figure 4:
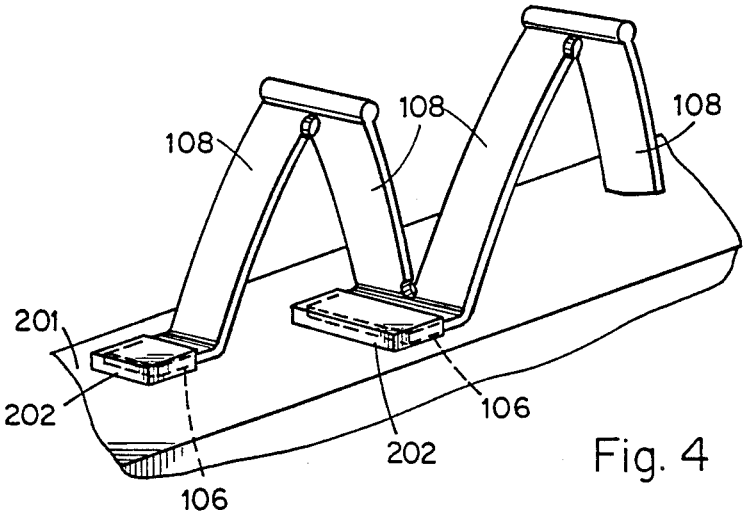
FIG. 4 is a perspective view of the strip of FIG. 2 after installation on a fixing blade.

In the case of a central slide constituted by rails, it may be necessary to provide a horizontal support, for example, a blade which may possibly be provided with specific places for receiving fixing tabs. This blade may be of metal, but also of suitable synthetic material. The specific places may be slight cavities but also slits through which the tabs are passed before fixing. By way of example, FIG. 4 shows the strip 100 of FIG. 2 attached to blade 201 having prefabricated notches or housings 202 which receive tabs 106 of the opened-out strip.

What is claimed is:

1. An anti-dazzle screen comprising:

a strip (1) having opposing upper and lower edges (2, 3), the strip being provided with notches (4) starting from the upper edge and notches (5) starting from the lower edge, the notches (4) issuing from the upper edge (2) and those (5) issuing from the lower edge (3) following one another alternately to form branches (8) in the space between two succeeding notches (4, 5), the notches (4, 5) terminating short of the opposing edge and having defined at the base thereof upper and lower connection parts (9, 10);

the upper connection parts (9) lying between two succeeding notches (4) emanating from the upper edge (2) and being above the intermediate notch (5) issuing from the lower edge (3) and in each instance joining the corresponding ends of two successive branches (8);

the lower connection parts (10) lying between two succeeding notches (5) emanating from the lower edge (3) and being below the intermediate notch (4) issuing from the upper edge (2) and in each instance joining the corresponding ends of two succession branches (8);

the lower connection parts (10) being at least partly foldable in order to form a tab (12) for resting and fixing the screen on an elongated support;

the strip (1) being opened-out along the length of the support to open the branches (8) around respective joints formed by the upper part (9) and the lower part (10) connecting two succeeding branches (8, 8) to move these branches apart and incline them one to the other and arrange their surfaces slantwise relative to the support to constitute an opaque screen in the direction along the screen.

2. The anti-dazzle screen of claim 1, wherein the upper connection part (9) includes a bead (103).

3. The anti-dazzle screen of claim 1, wherein the notches (4, 5) end in a rounded-off opening (13).

4. The anti-dazzle screen of claim 1, wherein the strip (1) is obtained by extrusion.

5. The anti-dazzle screen of claim 1, wherein the lower connection part (10) is extruded with tab (12), folded at a predetermined angle with respect to the branches (8).

6. The anti-dazzle screen of claim 1, further comprising a fixing blade (201) positionable on the central separation means of traffic lanes to receive the opened-out strip.

7. The anti-dazzle screen of claim 6, wherein the fixing blade (201) includes prefabricated means (202) for receiving the tabs (12) of the strip.

* * * * *